US007481346B2

(12) United States Patent
Vanden Berg et al.

(10) Patent No.: US 7,481,346 B2
(45) Date of Patent: Jan. 27, 2009

(54) HAMMER-TYPE STAPLER TOOL

(75) Inventors: Roger A. Vanden Berg, Hudsonville, MI (US); Roger C. Bruins, Hudsonville, MI (US); Ross Kooienga, Hudsonville, MI (US)

(73) Assignee: National Nail Corporation, Grand Rapids, MI (US)

( * ) Notice: Subject to any disclaimer, the term of this patent is extended or adjusted under 35 U.S.C. 154(b) by 0 days.

(21) Appl. No.: 11/652,333

(22) Filed: Jan. 11, 2007

(65) Prior Publication Data

US 2007/0164076 A1 Jul. 19, 2007

Related U.S. Application Data

(60) Provisional application No. 60/758,823, filed on Jan. 13, 2006.

(51) Int. Cl.
*B25C 5/00* (2006.01)
*B25C 5/11* (2006.01)

(52) U.S. Cl. ..... 227/147; 227/18

(58) Field of Classification Search ..... 227/18, 227/28, 106, 120, 133, 147; 411/442, 444; 206/197

See application file for complete search history.

(56) References Cited

U.S. PATENT DOCUMENTS 2,664,565 A * 1/1954 Percoco ..... 227/120
2,667,639 A 2/1954 Schick
3,319,864 A 5/1967 Adams
3,385,498 A 5/1968 Downie
3,596,820 A 8/1971 Lou
4,033,499 A 7/1977 Butler
4,182,474 A 1/1980 Sato
5,069,340 A 12/1991 Ernst et al.
5,184,752 A 2/1993 Zylka et al.
5,292,048 A 3/1994 Vanderwiel
5,339,983 A 8/1994 Caple
5,501,002 A 3/1996 Fukami
5,634,583 A 6/1997 McGuinness et al.
5,934,504 A 8/1999 Elliott
5,947,362 A 9/1999 Omli
5,975,401 A 11/1999 Fealey
6,012,623 A 1/2000 Fealey
6,027,004 A 2/2000 Ramella et al.
6,302,310 B1 10/2001 Lamb
6,478,209 B1 11/2002 Bruins et al.
6,508,392 B1 1/2003 Huang (Continued)

*Primary Examiner*—Rinaldi I. Rada
*Assistant Examiner*—Nathaniel Chukwurah
(74) *Attorney, Agent, or Firm*—Flynn, Thiel, Boutell & Tanis, P.C.

(57) ABSTRACT

A manually swingable hammer-type stapling tool having an elongate housing having a striker movably mounted thereon; a staple driving blade mounted on the housing and movable relative to the striker along a staple discharge path when the striker impacts against a surface; a staple magazine carried on said housing and containing a clip of staples so that a leading staple of the clip is disposed in a staple discharge path below the driving blade; and a cap supply and feeding arrangement mounted on the housing for positioning a cap in a discharge position wherein it is disposed below the leading staple, the arrangement including a cap magazine containing a significant number of individual caps disposed in adjacent and joined edge-to-edge relationship to define a connected strip of caps, and a manual feeding mechanism for advancing a leading cap of the strip into the discharge position.

24 Claims, 11 Drawing Sheets

U.S. PATENT DOCUMENTS

| | | | |
|---|---|---|---|
| 6,543,666 | B1 | 4/2003 | Huang |
| 6,550,660 | B1 | 4/2003 | Chlebowski et al. |
| 6,659,326 | B2 | 12/2003 | Huang |
| 6,837,412 | B2 | 1/2005 | Lamb |
| 6,918,523 | B1 | 7/2005 | Chou |
| 6,932,260 | B1 | 8/2005 | Chou |
| 6,966,389 | B1 | 11/2005 | Riggs |
| 7,232,050 | B2 | 6/2007 | Omli |
| 2002/0096548 | A1 | 7/2002 | Huang |
| 2002/0121069 | A1 | 9/2002 | Smeja et al. |
| 2003/0015565 | A1 | 1/2003 | Lee |
| 2003/0146261 | A1 | 8/2003 | Huang |
| 2003/0192930 | A1 | 10/2003 | Lamb |
| 2004/0079781 | A1 | 4/2004 | Huang |
| 2006/0118592 | A1 | 6/2006 | Ho |
| 2006/0186167 | A1 | 8/2006 | Omli |

* cited by examiner

HAMMER-TYPE STAPLER TOOL

CROSS REFERENCE TO RELATED APPLICATIONS

This application claims the benefit of U.S. Provisional Application Ser. No. 60/758,823, filed Jan. 13, 2006, which disclosure is incorporated herein by reference in its entirety.

FIELD OF THE INVENTION

This invention relates to a hammer-type cap stapling tool and, more specifically, to improvements in the constructional and operational features of such tool.

BACKGROUND OF THE INVENTION

Heavy duty stapling tools are widely used in the building or construction industry, with such tools being both of the power driven type, typically pneumatic driven tools, and manual type, commonly referred to as hammer-type staplers since the tool is manually swung and impacted against a surface such as a roof or wall substrate so as to effect ejection of a staple.

To permit use of staples for securing sheathing and sheeting to walls and roofs, often as a substitute for a cap nail, tools have been developed which position a plastic cap in the discharge path of a staple so that, upon operation, the staple penetrates the cap prior to penetrating the substrate so that the cap provides significantly increased gripping strength relative to the sheathing or sheet material being fastened over the substrate. Examples of power-operated staplers which also employ plastic caps are illustrated by U.S. Pat. Nos. 5,184,752, 6,302,310 and 6,478,209. In the tools of these patents, the basic stapling tool is pneumatically operated and mounts thereon a storage magazine for a plurality of plastic caps, with a leading cap being supplied into the staple discharge path for penetration by the staple during tool activation. While tools of this type perform a desirable and efficient stapling operation, nevertheless such tools are disadvantageous with respect to their cost and their need for connection to a power source, such as a source of pressurized air for operating the tool. These tools are also generally fairly large and heavy, and the associated air hose which connects to the tool makes tools of this type difficult to use when the sheathing or sheet material is being fastened to a relatively upright surface.

In addition, with many of the known tools, such as those illustrated in the U.S. Pat. Nos. 5,184,752 and 6,303,310 patents mentioned above, the tool includes a rather large upright canister for containing therein a vertical stack of caps, all of which are independent of one another, whereby loading of the tool with caps may be difficult, particularly when one considers the environment within which the tools are utilized.

Because of factors such as cost and complexity as associated with power tools as mentioned above, manually operated tools, specifically hammer-type staplers, are utilized, particularly by workmen who utilize such tool for smaller jobs or on a less frequent basis. Further, hammer-type staplers are more convenient to utilize when stapling sheathing or sheet material to a vertical or generally upright surface. In recognition of situations where hammer-type staplers are desired, it has been proposed to provide such hammer-type stapler with caps so as to increase the flexibility and improve the quality of the stapling operation being carried out. In this regard, U.S. Pat. No. 6,966,389 proposes a hammer-type cap stapler wherein a cap supply cylinder is attached to the tool for maintaining therein a vertical stack of independent caps, and the caps are discharged from the bottom of the cap cylinder so that a cap is automatically fed into the staple discharge path for penetration by the staple during each manual activation of the tool. The tool of this latter patent, however, also utilizes a vertical stack of independent caps, and hence possesses the same disadvantages as associated with such a cap arrangement as discussed above. Further, the tool of '389 has the cap supply cylinder positioned forwardly from the impact end of the tool, which is believed to cause overweighting of the head end of the tool and provide an undesirable balance with respect to the feel of the tool when gripped and manually operated. The positioning of the cap storage cylinder adjacent and protruding outwardly from the impact end of the tool also prevents the tool from being utilized in close association to a wall or obstruction which protrudes upwardly from adjacent the area where stapling is desired, and also interferes with overall operator visibility when using the tool.

Accordingly, it is an object of this invention to provide an improved cap fastener tool, specifically a manually-operated hammer-type cap stapling tool which is manually swung and impacted against a surface so as to cause a stapling operation, which improved cap stapling tool provides improved constructional and operational features which are believed to overcome many of the disadvantages discussed above.

More specifically, this invention relates to an improved manually-operated hammer-type cap fastener tool and preferably a cap stapler tool which, in a preferred embodiment, utilizes a cap supply defined by an elongated row of individual caps which are all serially joined edge-to-edge, with the lead cap as positioned in the fastener (i.e., staple) discharge path being separated from the serial cap strip during the fastener (i.e., staple) discharge operation, thereby providing improved control over the caps both during loading of the tool with caps, and during utilization of the tool.

A further object of the invention is to provide an improved hammer-type tool, as aforesaid, wherein the serially joined caps are wound spirally into a roll or coil which can be positioned in a storage magazine mounted on the tool, thereby improving loading and storing of caps on the tool.

It is a still further object of the invention to provide an improved hammer-type tool, as aforesaid, wherein the cap storage is mounted on the tool adjacent the grip end thereof whereby the cap storage does not complicate or enlarge the structure at the impact end of the tool, thereby providing improved visibility at the impact end of the tool and providing what is believed to be better feel and balance with respect to gripping and swinging of the tool.

Another object of the invention is to provide an improved hammer-type tool, as aforesaid, which has a cutting mechanism, similar to a scissor-type cutting structure, which effectively cuts the web or connecting strip which joins serially adjacent caps, with the cutting mechanism effecting cutting of the web so as to sever the lead cap from the remaining cap strip during the staple ejecting operation, thereby providing an improved staple/cap discharge operation which minimizes potential disturbance to the cap strip remaining in the tool.

A further object of the invention is to provide a cap stapler tool which enables the feeding of individual caps into a discharge position which is aligned with the staple discharge path wholly under the manual control of the tool user, and wholly independent of the actual staple-ejecting impact against a surface, thereby enabling all of the impact force as manually applied to the tool to be utilized for discharging the staple and causing it to penetrate both the cap and the surface, thus minimizing the manually-created impact force required for successful operation of the tool. This also enables the tool to be utilized as a conventional stapler merely by failure of the operator to advance a cap into the staple discharge position, thereby improving overall flexibility of use by permitting the tool to function as either a stapler or as a cap-stapler.

A still further object of the invention is to provide an improved cap-stapling tool which, by positioning the cap supply at the grip end of the tool, enables the caps to be fed from the cap supply along a guide path which extends lengthwise of the tool to the staple discharge end thereof, which guide path preferably extends through the hand grip of the housing and provides for confinement and protection of the caps being fed lengthwise of the tool while maintaining a tool which is simple and compact so as to maintain a convenient feel and balance, particularly during swinging of the tool during use thereof.

A still further object of the invention is to provide an improved cap stapling tool which, in addition to the capability of manual control over the advancing of the caps into the discharge position, obtains such control utilizing a simple mechanism which is manually activated by a trigger which protrudes from the grip part for convenient engagement with the operator's finger (or thumb), with depression of the trigger not only effecting advancing of a cap into the discharge position, but also preferably causing the trigger to enter into a pocket or recess formed in the tool grip so that the operator's hand comfortably surrounds and embraces the grip to permit convenient swinging of the tool and impacting thereof against a surface while maintaining the trigger in a depressed condition. A manual release of the finger from the trigger during the return movement of the tool away from the surface then resets the trigger so as to permit it to again be manually depressed so as to advance the next cap into the discharge position.

Other objects and purposes of the improved hammer-type cap stapling tool of the present invention will be apparent to persons familiar with stapling tools upon reading the following specification and inspecting the accompanying drawings.

SUMMARY OF THE INVENTION

This invention relates to a manually-operated hammer-type cap stapling tool which employs an elongate hammer-type stapling unit defined by an elongate housing having a staple magazine positioned lengthwise thereof and having a discharge path at the impact or head end of the housing which, upon impact of a striker as provided at the head end against a surface, causes a driving element on the housing to transversely discharge a staple disposed at a lead end of the staple magazine. The stapling unit has a manually-engagable grip part defined adjacent the other end of the housing. In a preferred embodiment of the tool, a cap storage magazine is fixed to the housing adjacent the grip end thereof and contains an elongate strip of caps which are peripherally joined edge-to-edge. The leading end of the cap strip is fed lengthwise along the tool so that the leading cap can be positioned to intersect the staple discharge path at the impact end of the tool. The tool preferably employs a manually-activated feeding mechanism which manually advances the caps, one at a time, into the discharge position, with the manual cap advance being independent of the impact actuation of the stapling unit. In the preferred embodiment, a cutting assembly having opposed relatively movable cutting edges is automatically activated when the tool is impacted against a surface so as to cut a connecting strip between the leading cap positioned in the staple discharge path, and the next adjacent cap, to facilitate efficient discharge of the staple and penetration thereof through the cap prior to its penetration into the impacted surface.

Figure 1:
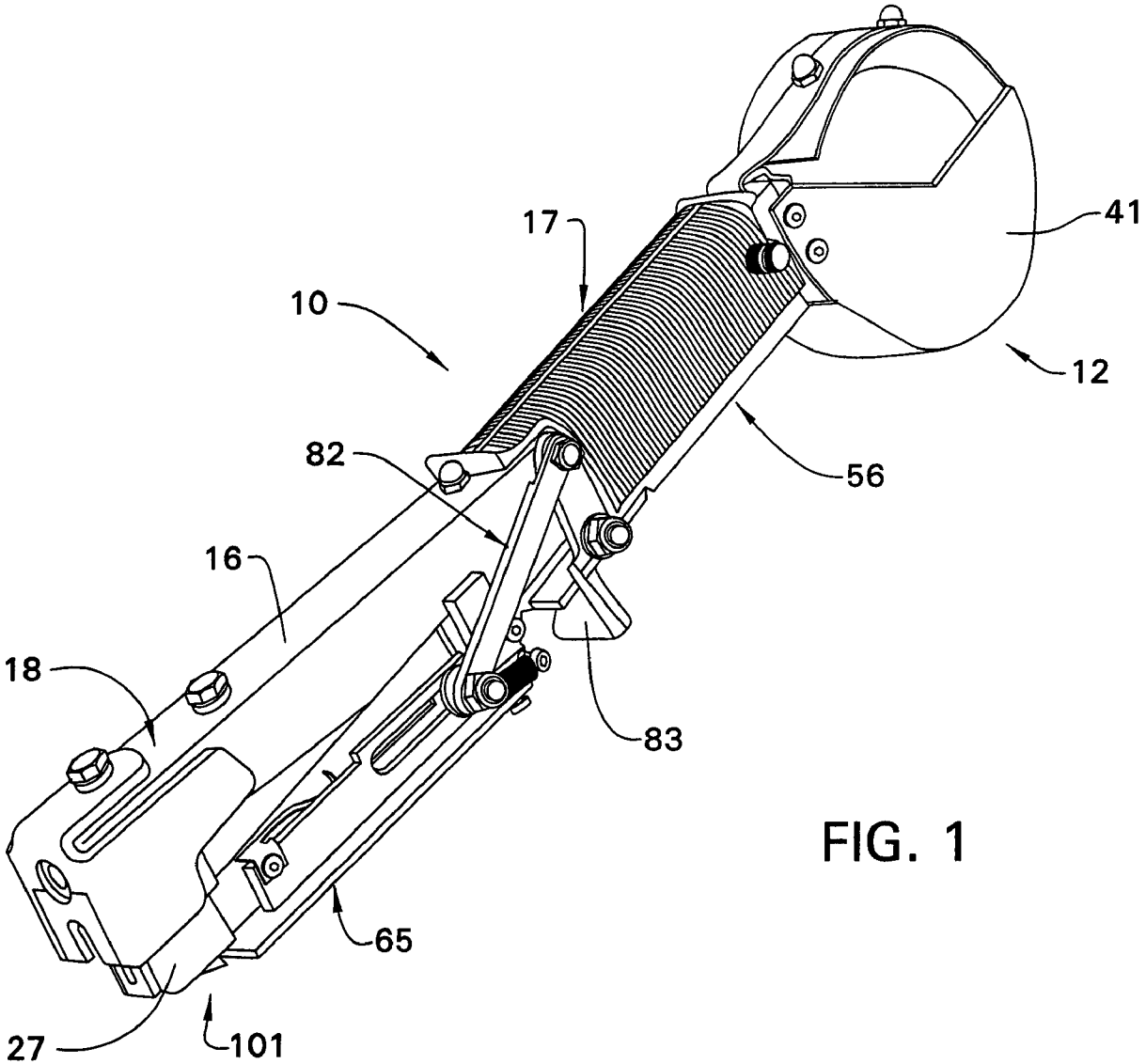
FIG. 1 is a perspective view of an improved hammer-type cap stapling tool according to a preferred embodiment of the present invention.
Figure 2:
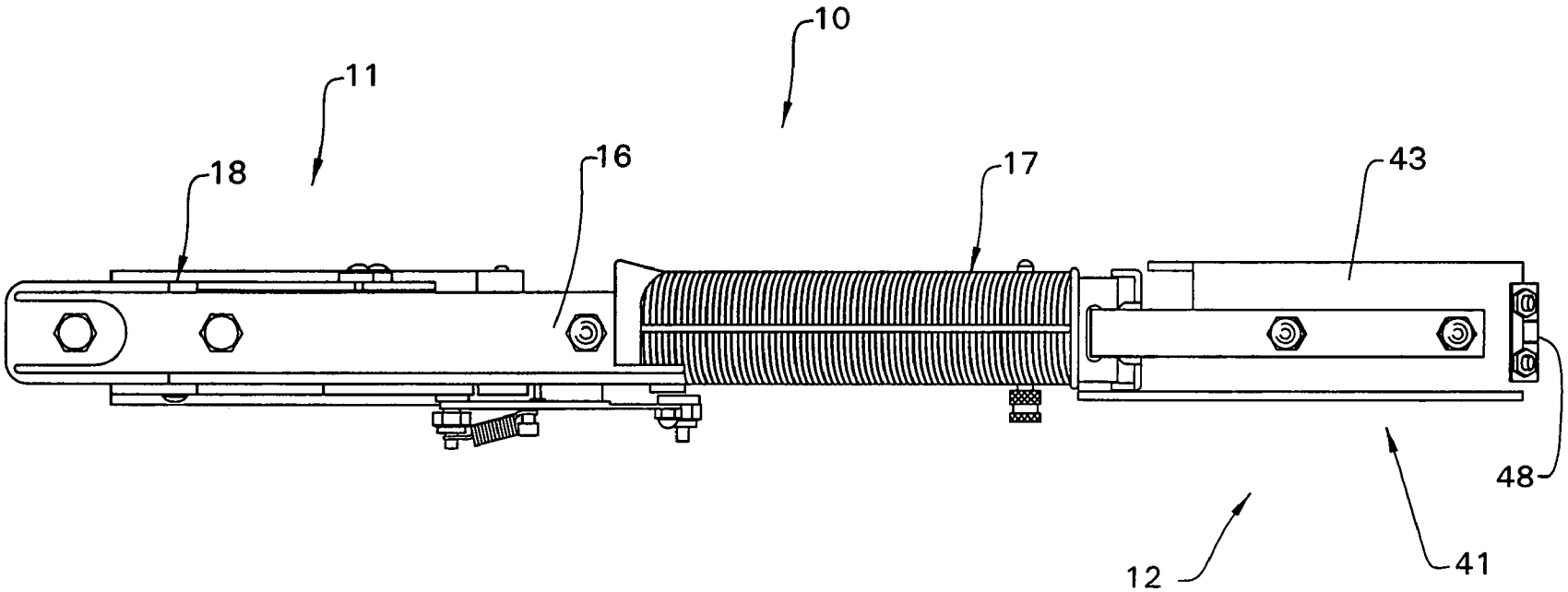
FIG. 2 is a top view of the tool illustrated in FIG. 1.
Figure 3:
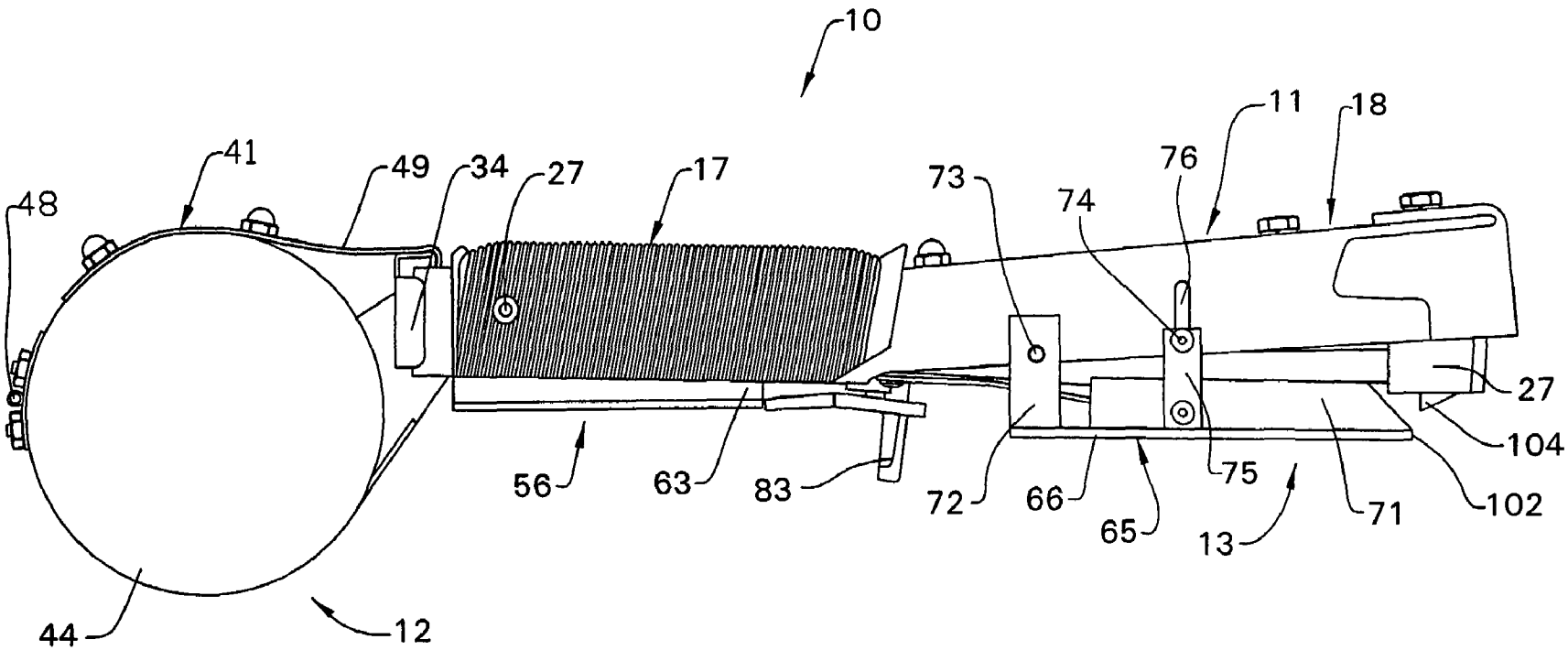
FIGS. 3 and 4 are respectively right and left side elevational views of the tool shown in FIGS. 1 and 2.
Figure 4:
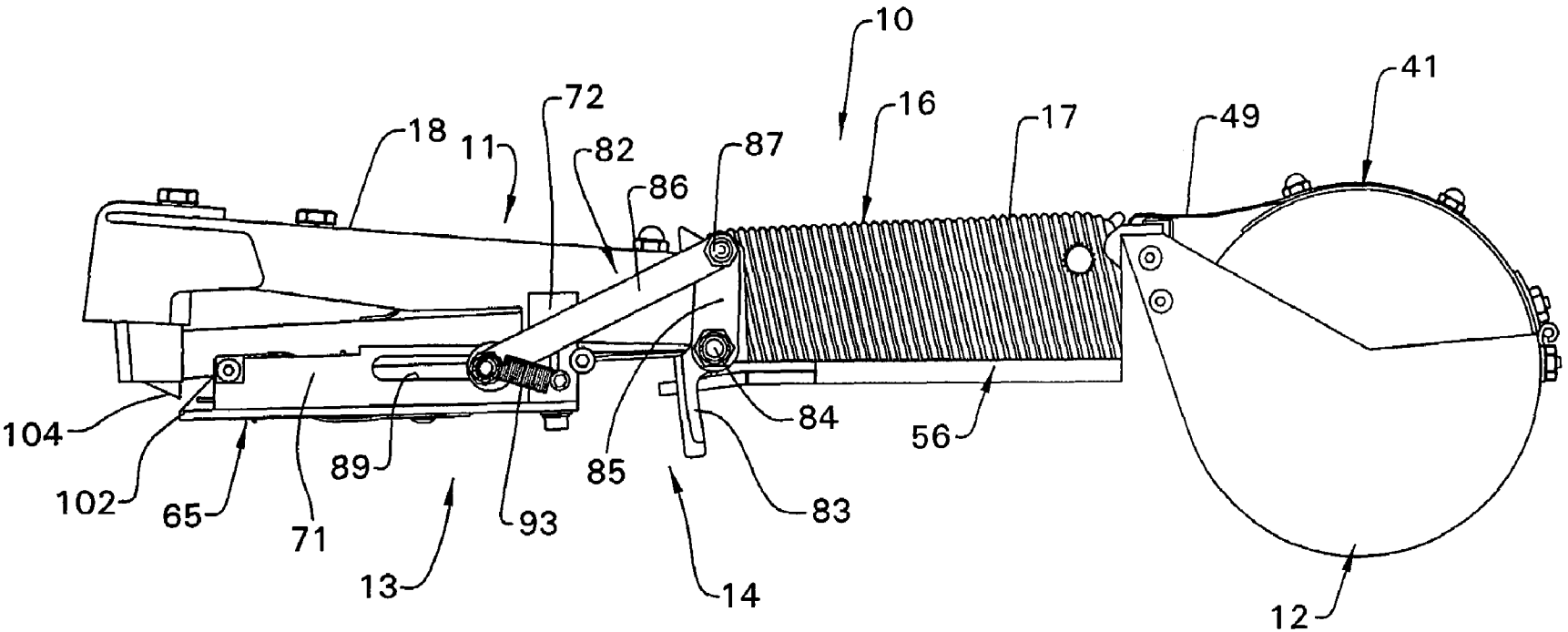

Certain terminology will be used in the following description for convenience in reference, and will not be limiting. For example, the words "upwardly", "downwardly", "rightwardly" and "leftwardly" will refer to directions in the drawings to which reference is made. The words "right" and "left" will also refer to those sides of the tool which are visibly observed by a user when the tool is manually gripped and held in a position of use. The word "forward" will be used to reference the normal direction of feeding movement of the caps and staples toward the discharge position, which movement in the illustrated tool is in a direction from the hand grip toward the head or impact end of the tool. The words "inwardly" and "outwardly" will refer to directions toward and away from, respectively, the geometric center of the tool and designated parts thereof. Said terminology will include the words specifically mentioned, derivatives thereof and words of similar import.

DETAILED DESCRIPTION

Referring to FIGS. 1-4, there is illustrated a preferred embodiment of a manually-operated hammer-type cap fastener tool 10 according to the present invention. This tool 10, in the disclosed and preferred embodiment uses staples as the fasteners, and is defined principally by a stapler unit 11 having a cap supply 12 mounted adjacent the grip end of the tool, a cap guide arrangement 13 extending lengthwise of the tool for feeding individual caps into a discharge position adjacent the head or impact end of the tool, and a cap feeding arrangement 14 which effects controlled feeding of caps toward the discharge position.

The stapler unit 11, considered by itself, is a generally conventional and well known structure, but will be described herein both for background purposes and for facilitating description of its structural and functional cooperation with the improved cap supply, feeding and discharge features associated with the present invention.

More specifically, the stapler unit 11 includes an elongate rigid housing 16 having a grip part 17 defined adjacent one end thereof, and a head part 18 which effectively defines the other end of the housing. The grip part 17 is traditionally of a hollow tubular cross section defining an opening 19 therethrough, and the head part 18 typically has a channel-shaped cross section so as to define therein a downwardly-opening interior channel 21, the latter communicating with the opening 19 which extends through the grip part 17. The housing 16, in close proximity to the free end of the head part 18, mounts therein a conventional staple driving member or blade 22 which cooperates for discharging a staple in a conventional manner, as discussed hereinafter.

The stapler unit 11 also includes an elongate staple magazine 23 which extends generally lengthwise of the housing 16 and is disposed so as to be at least partially nested or positioned within the housing 16 substantially throughout the length thereof. This staple magazine 23 includes an elongate generally hollow housing 24 which mounts therein a generally inverted U-shaped guide track 25, the latter cooperating with the inner wall of the housing 24 to define a generally channel-shaped guide groove 26 extending lengthwise of the housing 24. The guide groove 26 in a conventional manner accommodates therein a conventional staple clip, that is, an elongate row of U-shaped staples S positioned in adjacent side-by-side abutting relation. The staple clip is slidably supported on the interior guide track 25 and is urged forwardly toward the head end of the stapler unit so that the leading or endmost staple of the clip is positioned in alignment with a transverse discharge opening 28 associated with the head or impact end 27 (often referred to as the striker) of the magazine housing 24. The discharge opening 28 extends transversely through upper and lower walls of the staple magazine housing 24 so that the staple driving blade 22 as mounted on the main housing 16 is aligned with this opening, and hence is transversely aligned with the endmost staple of the clip so as to permit discharge of the endmost staple through the opening 28 along a discharge path 29 which extends generally transverse to the lengthwise extent of the stapler housing.

The bottom wall 36 of the striker 27, adjacent to the discharge opening 28, conventionally acts as the impact or striker surface inasmuch as this is the area or wall which typically impacts a surface during discharge of a staple into the surface.

The elongate staple clip positioned in the staple magazine housing 24 is normally urged forwardly by a channel-shaped pusher 31 which is slidably supported on the guide track 25 within the guide groove 26 for engagement with a rear end of the staple clip. This pusher 31 is slidably supported on an elongate guide rod 32 which extends lengthwise of the housing 24 and has its rearward end fixed to a removable or openable rear cover 34 which closes off the grip end of the housing 16. A conventional coil spring 33 surrounds the guide rod 32 and cooperates between the rear cover 34 and the pusher 31 to normally urge the staple clip forwardly so that the front endmost or lead staple abuts against a suitable stop and is maintained in transverse alignment with the discharge opening 28 for contact and discharge by the staple driving blade 22 during activation of the tool.

The staple magazine 23 has the rear end portion thereof disposed to project into the interior of the hand grip 17, and the main housing 16 and staple magazine housing 24 are coupled by a pivot 27 which extends transversely between the side walls of the housing grip part, thereby enabling the staple magazine 23 to be vertically swingably displaced relative to the housing 16 about the axis of the pivot 27. To accommodate such pivoting, the forward end of the staple magazine 23 is capable of nesting within the channel-shaped housing head part 18, but normally protrudes downwardly therefrom, being urged into this downwardly protruding position by a spring 35, such as a leaf spring, which cooperates between the top wall of the magazine housing 24 and the top wall of the main housing 16. Spring 35 normally maintains the staple magazine in its angled extended position wherein the head or free end of the staple magazine angles away and hence protrudes outwardly of the housing head part 18, with the staple magazine being maintained in this "normal" position due to the magazine housing 24 abutting a stop, such as the lower wall of the tubular housing grip part 17.

Both the construction and operation of the stapler unit 11 as described above, and as illustrated in the accompanying drawings, is conventional and well known. One example of a hammer-type stapler tool possessing these features is manufactured and sold under the Prebena brand name, Model No. HHPF09.

Considering now the cap supply 12 as associated with the improved tool 10 of this invention, this cap supply 12 includes a cap chamber or magazine 41 which is mounted on the housing 16 adjacent the free end of the grip part 17. This cap chamber 41 in the preferred arrangement projects outwardly from the free end of the housing generally in alignment with the lengthwise extent of the housing 16. The cap chamber 41 defines therein an interior compartment 42 which, in the illustrated embodiment, is generally cylindrical for storing therein a cap spool as described hereinafter. The cap chamber 41 is defined by a generally outer peripheral wall 43 which approximates a cylinder and which is oriented so that the axis thereof extends transversely of the housing and hence transversely with respect to the plane of swinging movement of the staple magazine 23. The outer peripheral wall 43, in the sideward extent of the tool, has a dimension which preferably does not significantly exceed the width of the tool grip part 17, and opposite ends of the cap compartment 42 are at least partially closed by end walls 44 and 45.

The cap chamber 41 is constructed so as to be readily opened to permit loading of a cap roll therein and, in the illustrated embodiment, this opening feature is permitted by defining the peripheral wall 43 from upper and lower arcuate parts 46 and 47 which are joined by a hinge 48, the latter defining a transverse hinge axis so that the upper wall part 46 and the end wall 44 fixed thereto can be swingably moved into an open position about the hinge 48 to hence allow access to the interior of the chamber for loading of a cap roll therein. The upper wall part 46, in close proximity to the end of the grip part 17, has a spring clip or hook 49 projecting therefrom, the latter being resiliently deflectable to engage within a slot formed in the top wall of the grip part adjacent the free end thereof to hold the upper peripheral wall of the cap chamber 41 in a closed position.

The chamber 41 is adapted to mount a cap roll or coil 51 therein, which roll is defined by an elongate row or strip of individual disc-shaped caps 52 positioned in adjacent edge-to-edge relationship, with the adjacent caps being suitably interconnected, such as by small plastic webs 53 which join between adjacent peripheral edges of the adjacent caps. The webs and caps can be formed, such as by molding or extruding, in a plastics forming operation which enables an elongate strip of caps to hence be formed, with the elongate strip of joined caps then being spirally wound to define the roll 51.

The individual caps 52 are typically molded of a plastics material, and typically have a slightly domed configuration in cross section, with the underside of the cap hence defining a shallow concave recess, and the upper surface of the cap having a shallow convex configuration. Such configuration permits limited resilient flexing of the middle of the cap when a staple or nail is driven therethrough, thereby providing increased gripping engagement between the periphery of the cap and the flat surface with which it is engaged. The disc-shaped plastic caps 52 are typically about one-inch in diameter. The construction of the caps 52, as well as the forming of the caps into an elongate strip wherein the adjacent caps are joined together by connecting elements such as molded plastic webs 53, and the subsequent forming of the strip into a generally spiral roll 51, is well known.

The leading end of the cap strip defined by the cap roll 51 as disposed in the cap chamber 41 is supplied through the guide arrangement 13 which extends lengthwise along the tool 10 so as to position the lead or endmost cap 52L of the cap strip in a discharge position 55 which is located directly below the staple discharge opening 28. For this purpose, the cap guide arrangement 13 includes a rear guide track 56 which extends lengthwise along the handle grip part 17 and preferably interiorly thereof. The rear guide track 56 is defined by an elongate guide passage 57 defined generally between vertically spaced top and bottom walls 58 and 59, with the latter wall 59 effectively functioning as the bottom wall of the handle grip part 17. The guide passage 57 has a height which is only slightly greater than the height of the caps 52 so as to enable the caps to slidably move therealong, and the width of this passage is such as to readily accommodate the width (i.e., diameter) of the caps. The guide passage 57 at its upstream end 61 opens into the interior compartment 42 of the cap chamber 41 to enable the cap strip defined by the roll 51 to be withdrawn from the chamber 41 and fed lengthwise into and through the guide passage 57. This latter guide passage 57 terminates at a downstream end 62 which, in the illustrated embodiment, is located approximately adjacent the forward end of the handle grip part 17, which end is about midway between opposite ends of the elongate housing 16. The handle grip part 17, throughout the length of one of the side walls thereof, has an elongate narrow opening or slot 63 formed therein, which slot 63 communicates directly with the guide passage 57 throughout the length thereof so as to facilitate positioning of the cap strip therein when a cap roll 51 is positioned into the cap chamber 41.

The cap guide arrangement 13 also includes a front guide track 65 which is associated with the head part 18 and extends lengthwise along at least part of the length thereof adjacent the bottom or underside of the tool 10. This front guide track 65 is defined by an elongate plate-like guide member 66 which is positioned below the bottom surface of the staple magazine 23 and extends lengthwise of the tool. The plate-like guide member 66 defines thereon an upper generally planar guide surface 67 for permitting the cap strip to be slidably and supportingly positioned thereon, and this guide member extends lengthwise from a rear edge 68 to a front edge 69. The rear edge 68 is located forwardly a small distance from the forward end of the rear guide passage 57 but, in actuality, the guide surface 67 and more specifically the cap guiding passage 70 defined thereabove is preferably approximately aligned with the rear guide passage 57 so as to permit unrestricted passage of the cap strip from the rear passage 57 to the front passage 70. The front edge 69 of the front guide member 66 is positioned close to but short of the discharge path 29, with the spacing between the front edge 69 and the discharge path 29 being approximately equal to the radius of the cap 52.

The front guide track 65 preferably has a pair of generally parallel but sidewardly spaced side walls 71 fixed to and projecting upwardly from the guide member 66, with the spacing between the side walls 71 being only slightly greater than the diameter of the caps 52. The upper guide surface 67 and the upwardly projecting side walls 71 hence define an upwardly-opening channel which functions as the front guide passage 70 in which the cap strip is slidably confined so as to be fed forwardly toward the discharge position 55.

The front guide track 65, in the illustrated embodiment, is vertically swingably supported on the elongate housing 16. For this purpose, a pair of sidewardly-spaced support plates 72 are fixed to the guide member 66 adjacent the rearward end thereof, and these support plates 72 sidewardly straddle the side walls of the housing 16. A transverse hinge 73 couples the side plates 72 to the housing side walls, thereby enabling the front guide track 65 to have at least limited vertical swinging movement relative to the housing 16, which swinging movement of the front guide track 65 with respect to the housing 16 is similar to and parallel with the swinging movement of the staple magazine 23 relative to the housing 16 except that the latter swinging movement occurs about the pivot 27.

The swinging of the front guide track 65 relative to the housing 16 is controlled by a stop pin 74 which is fixed relative to the front guide track 65, such as by being fixed adjacent the upper end of an upwardly protruding arm 75. The stop pin 74 protrudes into a vertically elongate slot 76 formed in the side wall of the housing 16. The length of slot 76 controls the swingable movement of the front guide track 65 relative to the housing 16 between permissible upper and lower positions.

The front guide track 65 also has a cap holddown spring 77 associated therewith. The holddown spring 77 is formed as an elongate leaf or plate spring which has a rearward end thereof fixed to the underside of the staple magazine housing 24. The holddown spring 77 projects forwardly in the elongate direction of the front guide track so that a free end portion of the spring 77 maintains contact with one or more of the caps disposed on the guide surface 67 as positioned in close proximity to the front edge 69, thereby maintaining the caps in engagement with the guide surface. The holddown spring 77 extends generally along the lengthwise centerline of the guide track so that the holddown spring effectively engages the caps along the upper centers thereof.

To control feeding and advancing of the cap strip forwardly along the guide arrangement 13 so as to advance the leading cap 52L of the strip into the discharge position 55, the tool 10 is provided with the cap feeding arrangement 14 which, in this preferred embodiment, is wholly manually controlled so as to permit feeding of a cap into the discharge position wholly independent of the staple discharging operation which is initiated by impacting the head end of the tool against a relatively rigid surface.

Figure 11:
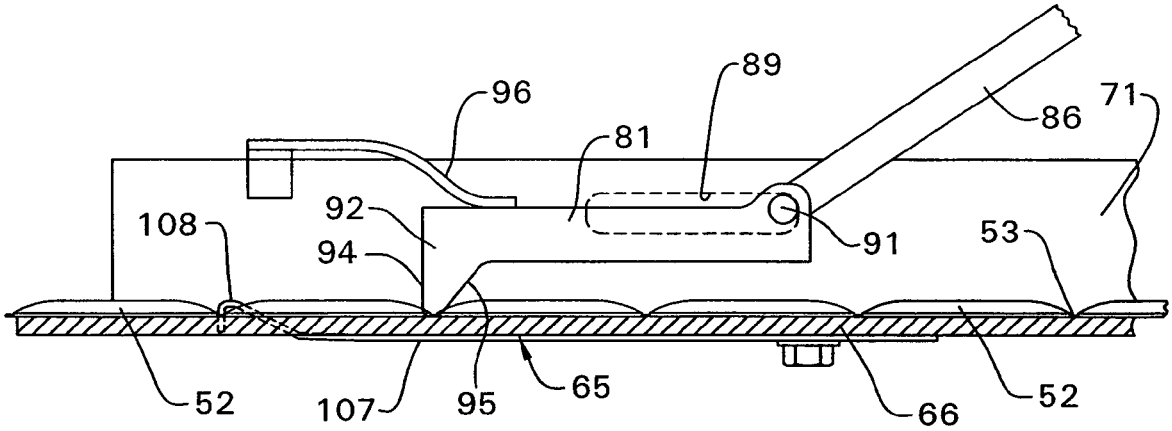
FIG. 11 illustrates the cap feeding mechanism as associated with the head end of the tool.
Figure 11A:
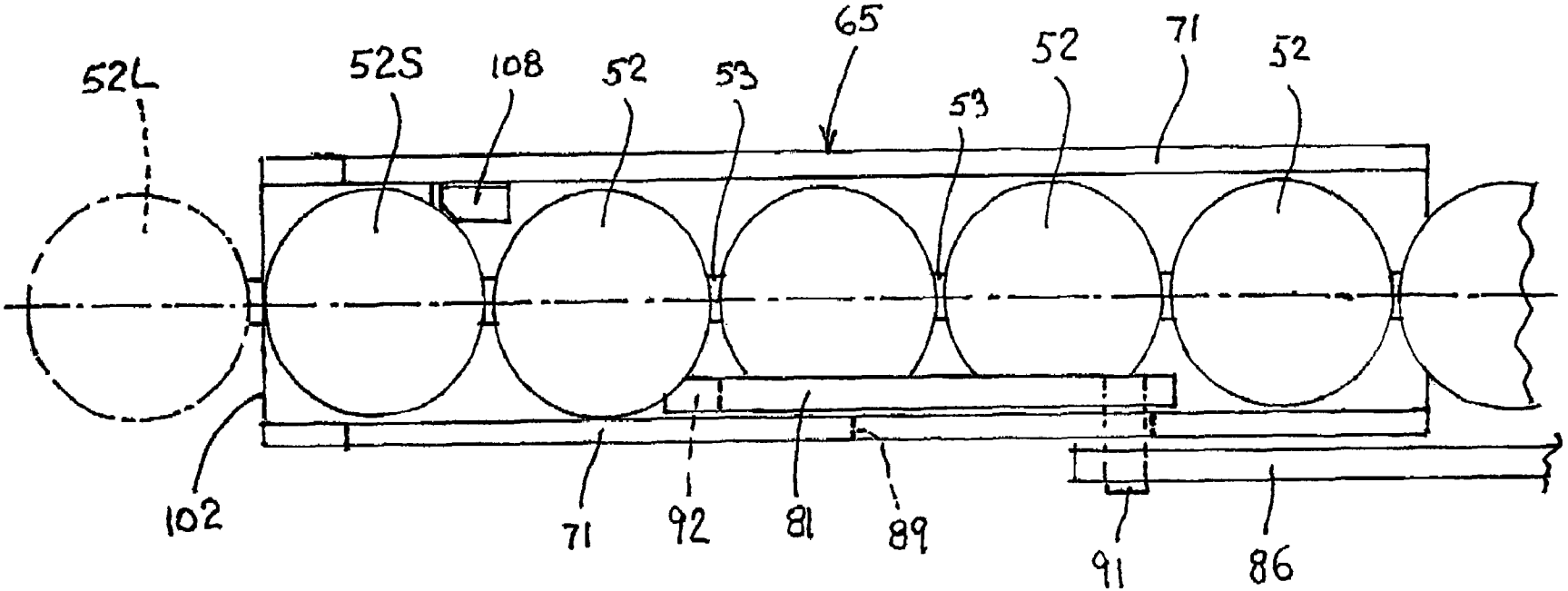
FIG. 11A is a top view thereof.

The cap feeding arrangement 14, as illustrated by FIG. 11, includes a cap feeding member 81 slidably carried on the front guide track 65 for cooperating with the cap strip supported thereon. This cap feeding member 81 is connected through a linkage 82 to a manual activating lever or trigger 83 which controls the movement of the cap feeding member 81 and hence the forward advancing movement of the caps. The activating lever or trigger 83 in the illustrated and preferred embodiment is positioned adjacent the underside of the housing 16 at a location adjacent the forward end of the housing grip part 17. The trigger 83 is adapted to project downwardly from the underside of the grip part so as to be accessible to and engaged with a forefinger. The trigger 83 is cantilevered downwardly from a pivot 84 which mounts to the housing 16 adjacent the bottom wall thereof, which pivot 84 defines a transverse axis so that the trigger is swingable generally within a vertical plane which corresponds to or is parallel with the vertical planes of movement associated with the staple magazine 23 and the front guide track 65.

The trigger 83, acting about the pivot 84, is rigidly joined to a first link 85 which projects upwardly from the pivot 84 and joins to one end of a second link 86 by a further pivot 87, the latter defining a transverse pivot axis which is parallel to the pivot axis 84. This second link 86 protrudes forwardly and downwardly along one side of the housing 16 and, at its forward end, is joined by a third pivot 91 to a rearward end of the cap feeding member 81. The pivot 91 defines a transverse pivot axis which is generally parallel to the pivot axes defined by the pivots 84 and 87. Pivot 91 has associated therewith a slide or pin which protrudes into an elongate slot 89 associated with one of the side walls 71, which slot 89 extends generally parallel with the guide surface 67. The confinement of the slide or pin, as associated with the pivot 91, within the slot 89 hence confines the rearward end of the cap feeding member 81 for linear forward and rearward movement generally toward and away from the discharge position 55.

The cap feeding member 81, at a location more closely adjacent the forward end thereof, namely spaced forwardly a substantial distance from the pivot 91, has a downwardly protruding drive lug 92, the latter having a generally straight front face 94 and a generally sloped or inclined rear face 95. A holddown spring 96, namely a cantilevered plate or leaf spring, has one end thereof mounted on the side wall 71, and the free end of this spring bears against the upper surface of the cap feeding member 81 at a location spaced from the pivot axis 91 so as to exert a downward biasing force on the cap feeding member 81 which urges the drive lug 92 downwardly for engagement with the cap guiding surface 67. The drive lug 92, when the cap driving member 81 is in its fully retracted or fully advanced position, is normally positioned to protrude downwardly through a clearance gap defined between adjacent caps associated with the cap strip, which clearance gap is defined adjacent the side of the cap strip due to the circular contour of the individual caps. The flat front face 94 can hence engage a rear side of a cap and push it forwardly during forward advancing of the cap feeding member 81. When the cap feeding member 81 is retracted, however, the rear sloped surface 95 cams upwardly over the cap, in opposition to the urging of the holddown spring 96, thereby enabling return of the cap feeding member 81 and repositioning of the lug 92 for engagement with the next succeeding cap.

Figure 5:
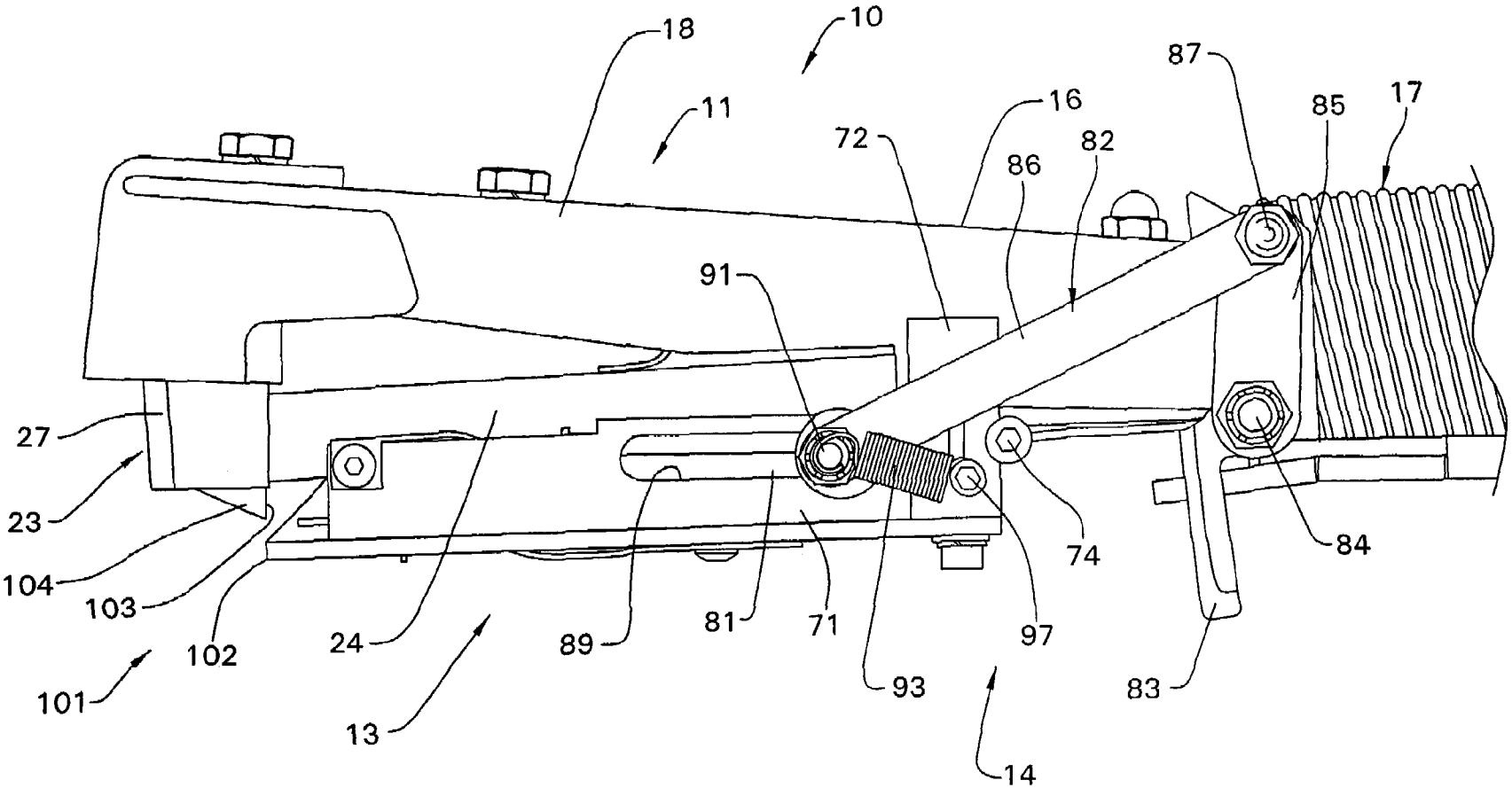
FIG. 5 is a fragmentary, enlarged left side elevational view of primarily the head end of the tool.

The linkage 82 associated with the cap feeding arrangement, in addition to the links 85 and 86, also includes a return spring 93, such as a coil spring, for returning the linkage 82 as well as the cap feeding member 81 and trigger 83 to the retracted positions illustrated by FIG. 5. This spring 93, in the illustrated embodiment, has one end thereof coupled to the pivot pin 91 and the other end thereof connected to an anchor pin 97 which is fixed to the front guide track, whereby spring 93 always urges the pivot pin 91 toward the rearward end of the guide slot 89.

Figure 10:
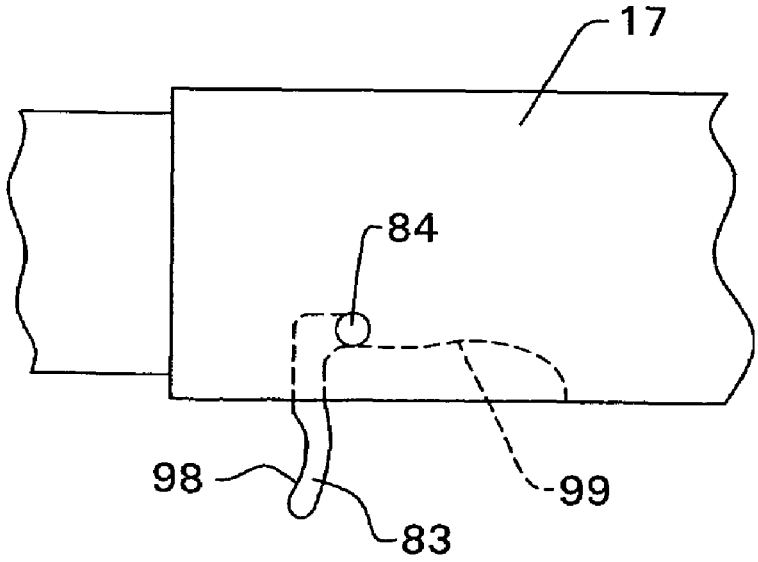
FIG. 10 is a diagrammatic view of a part of the hand grip and illustrating a trigger-receiving recess formed in the grip.

The trigger 83, as illustrated by FIG. 10, may be provided with a contour 98 on the front side thereof, namely the side engaged with the forefinger of the user. The contour 98 preferably constitutes a shallow concave recess in the up and down or radial direction of the trigger, although this contoured surface 98 in the transverse or sideward direction can additionally have a rounded convex shape so as to optimize comfort of the contact between the trigger and the user's forefinger.

In addition, the grip part 17 of the housing, and specifically the underside thereof at the forward end in the vicinity of the trigger 83, is preferably provided with a cut-out or recess 99 which is sized to permit the trigger 83, when manually swung rearwardly and upwardly so as to advance a cap, to be positioned upwardly into the recess 99 so that the trigger 83 in the activated position is hence generally flush with (in contrast to protruding downwardly from) the lower surface of the handle grip part. This hence enables the user to maintain a full gripping engagement with the handle grip part, while maintaining the trigger in its depressed condition, and at the same time permitting swinging of the tool and impacting of the head end thereof against a relatively rigid surface so as to permit discharge of a staple into and through a cap and then penetration of the staple into the rigid surface.

The cap stapling tool 10 of this invention also has a cutting assembly 101 associated therewith for cutting the web 53 which extends between the lead cap 52L as disposed in the discharge position 55 and the remainder of the cap strip at the time the tool 10 is activated to effect discharge of the staple. The cutting assembly 101 has a scissor-like cutting action defined by a first or lower cutting edge 102 as defined by the front edge 69 of the front guide track which hence functions as a movable cutting member, and an upper or second cutting edge 103 defined on a cutting member 104 which is fixed to and protrudes downwardly from the striker impact surface 36. This cutting member 104 is positioned adjacent but protrudes rearwardly away from the staple discharge opening 28, whereby the cutting edge 103 defined thereon is spaced rearwardly from the staple discharge opening 28 by a distance which approximately equals the radius of the cap 52, whereby the cutting edge 103 is disposed substantially directly over the web 53 joining the lead cap 52L to the next adjacent or succeeding cap as designated 52S in FIG. 6. The cutting edges or surfaces 102 and 103 are substantially vertically co-planar, but are horizontally spaced a very small distance apart so that the lower cutting edge 102 passes upwardly adjacent and overlaps the upper cutting edge 103 to effect severing of the web 53 when the tool head is impacted against a surface.

The cutting member 104 is preferably provided with a sloped or tapered front surface 105 which slopes upwardly as it projects forwardly away from the lower edge of the cutting surface 103. The tapered surface 105 is preferably configured similar to the taper or slope provided on the upper surface of the cap 52 so as to effect clamping engagement with the upper surface of the cap 52L in the discharge position during impacting of the tool and discharging of the staple.

Figure 9:
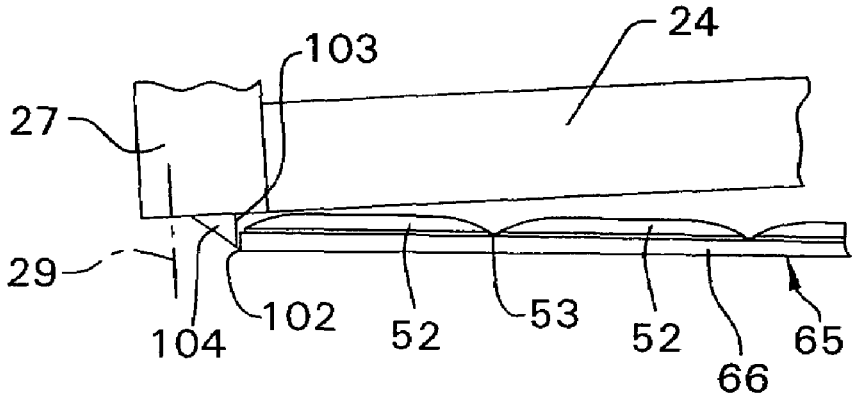
FIG. 9 is a side fragmentary view showing the cutter assembly in an activated position, and the lead cap held between the staple magazine housing and the guide track.

In addition to the clamping of the lead cap 52L between the cutting member 104 and the surface during impacting of the tool 10 against the surface, this impacting also causes the lower track member 65 to swing upwardly toward the staple magazine 23, which upward swinging of the front guide track not only causes the lower cutting edge 102 to swing upwardly and effect severing of the web 53, but also causes the succeeding cap 52S to be clampingly held between the guide surface 67 and the under surface of the staple magazine housing 24 substantially as illustrated in FIG. 9, thereby assisting in positively and positionally retaining the remaining cap strip within the cap feeding passages of the tool during the separation of the lead cap 52L from the strip and the penetration thereof by the discharged staple.

The cap stapler tool 10, throughout the lengthwise extent of the housing grip part 17, is preferably provided with a suitable grip wrap or covering 109 extending therearound, except for the narrow access slot 63 extending lengthwise along the side wall thereof, which wrap or covering 109 is preferably of a plastic or rubber-like material having at least limited elasticity and cushioning characteristics to provide increased gripping comfort while also providing at least some shock absorbing capability.

The front guide track 65 also preferably has an anti-backup pawl or member associated therewith to assist in preventing backward movement of the cap strip along the guide surface 67. Such anti-backup clip or pawl is defined by a cantilevered spring member 107 having a pawl-like protrusion 108 positioned adjacent one side of the guide surface 67 so as to protrude into the gap between adjacent caps, which pawl deflects out of position during forward advance of the caps, but forms a positive abutment for preventing rearward movement of the caps. Such anti-backup pawl can be formed similar to but function in a reverse manner to the cap feeding member 81.

While the operation of the tool 10 of the present invention is believed understood in view of the structural and operational description presented above, it will nevertheless be hereinafter briefly described to ensure a complete understanding thereof.

Figure 12:
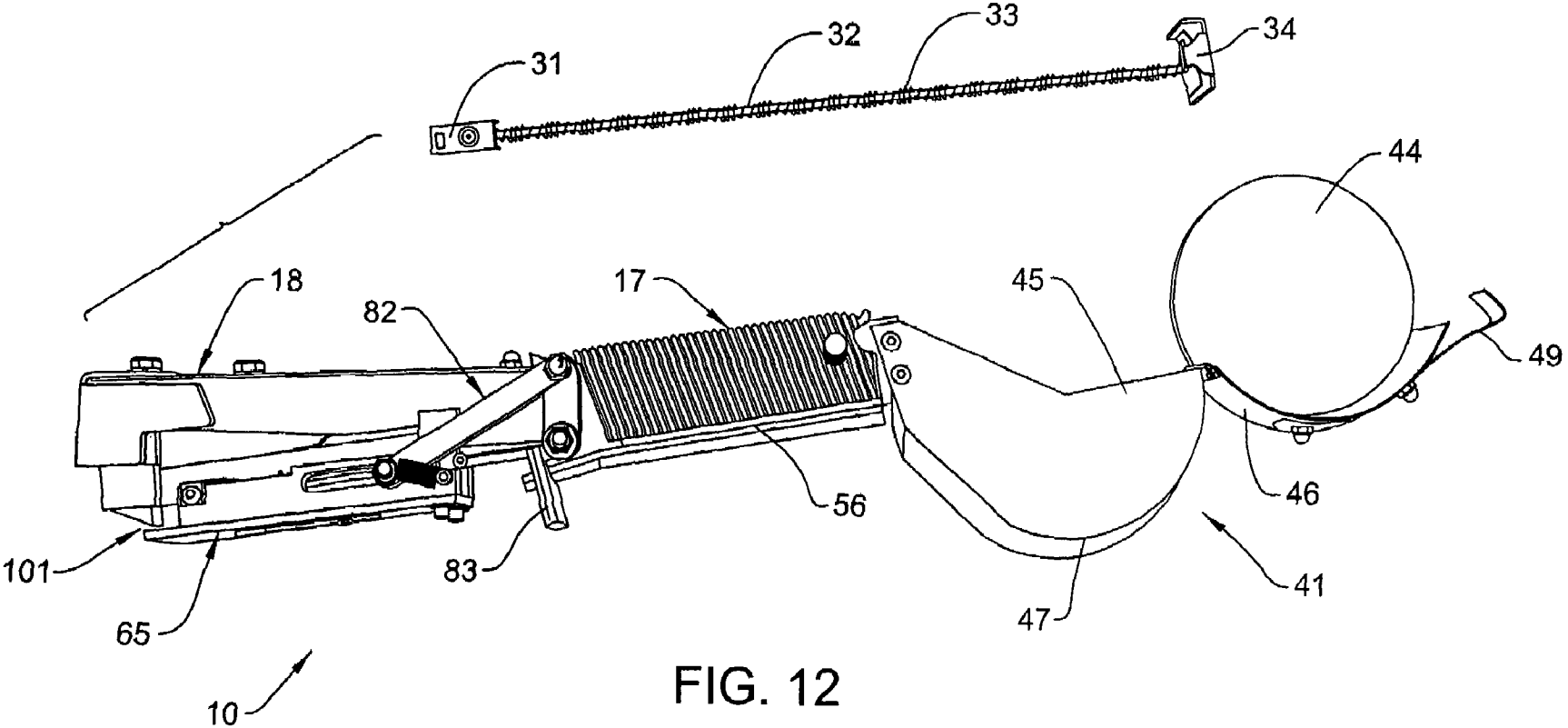
FIG. 12 is a side view of the tool showing it in an open position so as to permit loading of a staple clip and a cap roll therein.

With the cap magazine 41 in an open position generally as illustrated by FIG. 12, a cap roll 51 can be manually positioned in the interior chamber 42, and the leading end of the coiled cap strip can be sidewardly inserted through the slot 63 into the guide passage 57. The leading end of the cap strip is then fed longitudinally into the rearward end of the guide passage 70 defined by the front guide track 65, with the leading end of the cap strip being manually moved forwardly until the leading cap of the strip is positioned adjacent the front edge 69. When so positioned, the drive pawl 92 associated with the cap feeding member 81 should be positioned in the gap between two adjacent caps, such as between the second and third caps spaced from the front edge 69.

Prior to insertion of the cap roll, the end cover 34 associated with the staple magazine 23 can be opened and the spring rod and pusher removed to permit a fresh staple clip to be inserted, whereupon the pusher and spring rod are re-inserted and the rear cover 34 re-mounted. With the staple magazine 23 and the cap magazine 41 both loaded, the cap magazine is closed, and the tool 10 is now ready to use.

Assuming that the lead cap has not been advanced into the discharge position 55 wherein it is disposed so as to intersect the discharge path 29, then the tool 10 can be used in a conventional manner so as to discharge solely staples by gripping the hand grip 17, and then manually swinging the tool 10 so that the head end of the staple magazine impacts a relatively rigid surface, thereby causing the staple magazine 23 to swing upwardly into the housing 16, whereby the driving blade 22 effects discharge of the lead staple through the discharge opening 28 along the discharge path 29, thereby causing the discharged staple to penetrate the impacted surface.

Figure 6:
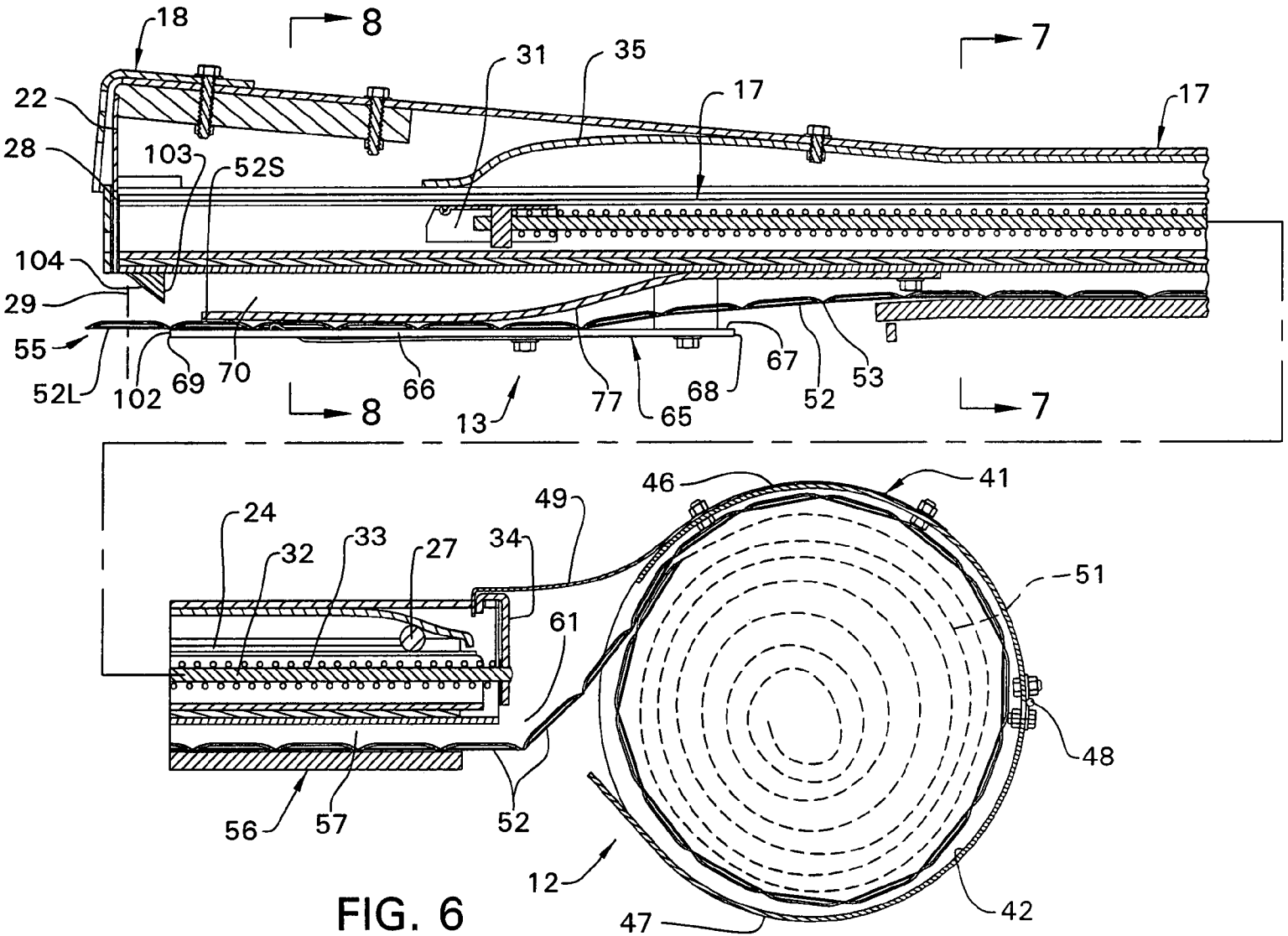
FIG. 6 is a sectional view of the tool as taken generally along a lengthwise or longitudinally extending central upright plane.
Figure 7:
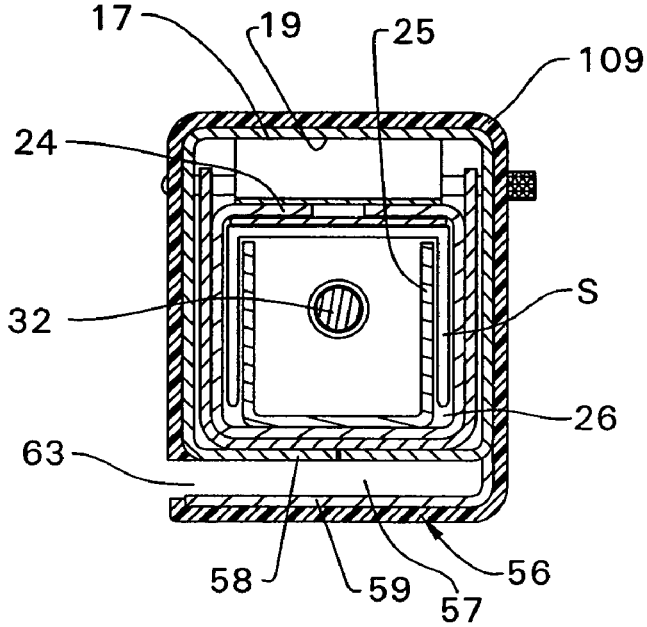
FIG. 7 is an enlarged cross-sectional view taken generally along line 7-7 in FIG. 6.
Figure 8:
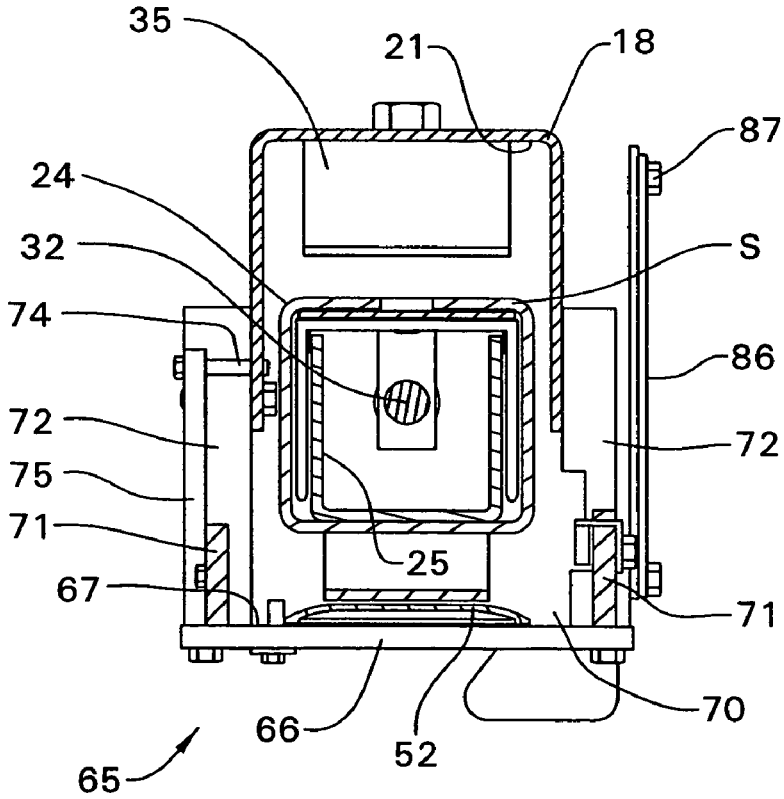
FIG. 8 is an enlarged cross-sectional view taken generally along line 8-8 in FIG. 6.

When use of the tool in the preferred manner is desired, namely so as to position a plastic cap 52 for penetration by the staple upon discharge thereof, then the operator will manually grip the tool 10 in a normal manner, and will position his forefinger for engagement with the outwardly or downwardly protruding trigger 83. By manually pulling his forefinger rearwardly to depress the trigger 83 back into the trigger recess 99, this causes the second link 86 to be moved forwardly and causes the cap feeding member 81 to be forwardly advanced against the urging of the spring 93. During this forward advance, the distance of which corresponds generally to the diameter of one cap 52, the drive lug 92 engages the rear edge of one of the caps, namely the rear edge of the second cap disposed in line in the illustrated embodiment, thereby causing the lead cap as disposed adjacent the front edge 69 to be advanced forwardly into the discharge position 55. In this latter position, the lead cap 52L is effectively unsupported except for its connection via the web 53 to the next adjacent cap 52S. The operator can then swing the tool 10, preferably with the trigger 83 still depressed, which swinging causes the lead cap 52L in the discharge position 55 to swing into contact with the cutting member 104, with the forward edge of the front guide track 65 initially impacting the surface and causing the lower cutting blade 102 to swing upwardly and effect cutting or severing of the web 53. At this time, the now new lead cap of the strip, namely the cap 52S in FIG. 6, is effectively clamped between the guide surface 69 and the bottom surface of the staple magazine housing 24 as illustrated in FIG. 9.

Substantially simultaneously with the above cutting operation, the cap 52L in the discharge position and the cutting member 104 impact the surface and cause the staple magazine 23 to telescope upwardly into the head end of the housing 16 due to the continued downward movement of the housing 16 caused by the swinging energy imparted thereto by the user. This collapsing of the staple magazine 23 into the housing hence causes the staple driving blade 22 to effect discharge of the lead staple through the discharge opening 28 generally along the discharge path 29, which staple discharge occurs in a generally conventional and well known manner. The discharge of the staple, and the presence of the separated cap 52L in the discharge position, causes the legs of the staple to initially penetrate the cap 52L prior to penetrating the surface. The penetration of the staple through the cap also typically causes the center domed portion of the cap to be resiliently depressed, thereby increasing the gripping pressure between the periphery of the cap and the surface to which it is secured.

After impacting of the tool 10 against the surface and discharge of the cap-staple combination, the tool 10 is repositioned so that the operator can now initiate a new cap-staple operation. For this purpose, the operator releases the trigger 83 at any time following the cap staple operation since, when the trigger 83 is released and the tool 10 is disengaged from the surface, the spring 93 automatically returns the cap feeding member 81 to its retracted position and, acting through the linkage 82, returns the trigger 83 to its extended position. When in its reset position, the user can again depress the trigger 83 to advance the next cap 52 into the discharge position 55, followed by impacting of the tool 10 against the surface so as to substantially simultaneously effect severing of the lead cap from the cap strip and discharge of a staple through the cap into the surface.

In carrying out the operation of the tool 10 as summarized above, it will be appreciated that the actual advancing of the cap into the discharge position, due to the depression of the trigger 83 by applying forefinger pressure thereto, can be carried out while the operator is initiating the swinging of the tool for effecting impact of the head end thereof with the surface.

Since the cap magazine 41 is located at the remote end of the tool 10 relative to the discharge end, and in fact protrudes lengthwise away from the end of the housing handle grip, coupled with the fact that the cap strip is fed generally lengthwise along the underside of the tool, the presence of the cap supply and feed on the tool do not interfere with the head end of the tool with respect to its stapling function and its visibility during use. Further, the head end of the tool remains virtually unobstructed both forwardly and sidewardly thereof, whereby the tool can be used for discharging a staple into a surface in close proximity to a wall or obstruction protruding outwardly or upwardly from the surface. The cap magazine and its disposition adjacent the rearward end of the hand grip is also believed to maintain desired balance of the tool with respect to gripping and swinging of the tool, while at the same time locating the cap magazine and much of the cap guide path at a location which is more effectively isolated from the violent or severe impact forces which are imposed on the tool when the head end thereof is impacted against a surface for effecting staple discharge.

While the cap feed mechanism 81 for permitting manual control over the feeding of a cap into the discharge position independent of the impact-caused staple discharge operation causes the cap advance to occur during the manual displacement of the trigger, and such is believed preferable, nevertheless it will be appreciated that the cap feed mechanism can be suitably reversed so that the manual actuation of the trigger or other activating member is such as to cause retraction of the cap feeding member, with a spring return then causing advancing of the cap feeding member and corresponding advancing of the cap into the discharge position. This latter mode of operation, however, is believed less desirable in that it provides less sense of control over the actual cap feeding, and provides less suitable contact and control over manual displacement of the activating trigger.

While the tool 10 as illustrated and described above has the series of caps as discharged from the cap magazine extending generally lengthwise along the stapler unit in a generally in-line relationship with the tool, it will nevertheless be understood that the cap magazine and the feeding track for the caps can themselves be offset to one side of the tool so that the caps are fed into the discharge position in angled relationship to the elongated direction of the stapler unit. As a still further alternative, while the caps can still be fed in-line lengthwise along the tool to the discharge position, the actual cap magazine itself can be disposed in an angled relationship relative to this lengthwise direction of the tool since the strip of interconnected caps possesses sufficient flexibility to permit the cap strip to be displaced and moved through a gradual curvature or bend.

As a still further variation, the front guide track 65 can be fixedly mounted on the staple magazine housing 24, and in such case a separate lower cutting member having the lower cutting blade 102 thereon will be provided and swingably mounted, such as from the housing 24, so as to swing upwardly for cooperation with the upper cutting blade 103 to create the same cutting function described above.

It will also be understood that the activating trigger 83 can also be positioned at other locations relative to the housing, the selected location being a function of the manual activating motion desired.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a manually swingable hammer-type stapling tool including an elongate housing having a striker movably mounted thereon adjacent a forward end thereof, a staple driving blade mounted on the housing adjacent said forward end and movable relative to the striker along a staple discharge path when the moving striker impacts against a surface, a staple magazine carried on said housing and containing a row of staples urged toward the staple discharge path so that a leading staple of the row is disposed in said staple discharge path below said driving blade, and a cap supply and feeding arrangement mounted on the housing for positioning a cap in a discharge position wherein it is disposed below the leading staple and transversely intersects the staple discharge path so that movably impacting the striker against the surface causes the driving blade to eject the leading staple which penetrates the cap and the surface, comprising the improvement wherein the cap supply and feeding arrangement includes a cap magazine containing therein a significant number of individual caps disposed in adjacent and joined edge-to-edge relationship to define a connected strip of caps, and a manual feeding mechanism for advancing a leading cap of said strip into said discharge position independently of the staple-ejecting impact of the striker against the surface, said feeding mechanism including a manually moved trigger member which is engaged and moved by a user to control advancing of the leading cap into the discharge position.

2. A stapling tool according to claim 1, wherein the elongate housing has a hand grip at a rear end thereof which is remote from the driving blade, and wherein the cap magazine is fixedly mounted to said housing adjacent said hand grip.

3. A stapling tool according to claim 2, wherein the hand grip is positioned between the cap magazine and the staple driving blade in the lengthwise direction of the housing.

4. A stapling tool according to claim 3, including a cutting mechanism having opposed relatively movable cutting blades positioned above and below the cap strip in the vicinity of the discharge position for severing the leading cap as disposed in said discharge position from the cap strip when the striker impacts the surface and effects discharge of the leading staple.

5. A stapling tool according to claim 2, wherein the strip of caps is spirally wound to form a roll which is positioned within the cap magazine as mounted to the housing.

6. A stapling tool according to claim 1, wherein the feeding mechanism includes a reciprocally movable feed member which engages a said cap which is positioned close to but sidewardly spaced from the staple discharge path, said feed member being advanced to move the leading cap of the strip into the discharge position when the trigger member of the feeding mechanism is manually moved in a feeding direction, said feeding mechanism also including a return spring for returning the trigger member and the feed member in an opposite direction to normally maintain them in a retracted position wherein the next cap can be manually fed into the discharge position.

7. A stapling tool according to claim 1, wherein the housing includes an elongate upper housing member having said driving blade mounted thereon adjacent the forward end thereof and a hand grip mounted thereon adjacent the rearward end thereof;

said staple magazine including an elongate lower housing member movably carried on said upper housing member and mounting the staple row therein so that the leading staple is positioned adjacent a front end of said lower housing member, said lower housing member at said front end thereof defining said striker which is positioned for impacting a surface during use of the tool; and said cap magazine being fixedly carried on said upper housing member adjacent said rearward end thereof.

8. A stapling tool according to claim 7, wherein said hand grip is positioned between said cap magazine and said staple driving blade in the lengthwise direction of the upper housing member.

9. A stapling tool according to claim 8, wherein the elongated cap strip is spirally wound to define a roll which is positioned in the cap magazine, and wherein the caps defining the strip are constructed of a plastics material and are serially joined in edge-to-edge relationship by small plastic connectors.

10. A stapling tool according to claim 9, including a cutting mechanism having opposed relatively movable cutting blades positioned above and below the cap strip in the vicinity of the discharge position for severing the plastic connector connected to the leading cap as disposed in said discharge position when the striker impacts the surface and effects discharge of the leading staple.

11. A stapling tool according to claim 1, including a cutting mechanism having opposed relatively movable cutting blades positioned above and below the cap strip in the vicinity of the discharge position for severing the leading cap as disposed in said discharge position from the cap strip when the striker impacts the surface and effects discharge of the leading staple.

12. A manually-swingable hammer-type stapler for discharging both a cap and a staple which penetrates the cap, comprising:

an elongate manually-swingable impact-activated stapling tool including an elongate housing having an elongate staple magazine extending in a lengthwise direction thereof;

the elongate tool adjacent a forward end thereof having a striker which is transversely moveable relative to the housing in response to impact of the striker against an external surface;

the elongate stapling tool adjacent said forward end thereof having a staple driving blade movable relative to the striker along a transverse discharge path for discharging a leading staple from said staple magazine when said striker is movably manually impacted against said external surface;

the elongate tool adjacent a rearward end of the elongate housing defining a manually engagable grip structure for engagement with a user's hand to permit manual swinging of the tool for impacting said striker against the external surface which causes the forward end of the tool to continue moving toward the surface so as to eject the leading staple;

a cap magazine fixedly carried on said housing adjacent said rearward end thereof, said cap magazine supporting therein an elongate strip of caps which are disposed in serially adjacent edge-to-edge relationship;

a guide structure for guiding a leading end portion of the cap strip from said cap magazine to a position adjacent said forward end of said tool so that a leading cap of said strip is positionable in a discharge position adjacent and generally transversely aligned with the leading staple;

a cap feeding mechanism which operates independently of the staple-ejecting impact of the striker against the external surface for moving the leading end portion of the cap strip away from the cap magazine and moving the leading cap into the discharge position for penetration by the leading staple when the latter is transversely discharged; and said feeding mechanism operating solely in response to application of a user-applied manual activating force to a movable manually-engagable trigger member which is movably mounted on said elongate housing and is manually displaceable in a first direction, and a spring for moving the trigger member in a second direction opposite said first direction, the feeding mechanism effecting advancing of the leading cap into the discharge position only during or after said trigger member is manually displaced in said first direction by application of a moving force to the trigger member by engagement thereof with the user's finger.

13. The stapler according to claim 12, wherein the leading cap is advanced into the discharge position as the trigger member is manually displaced in said first direction.

14. A stapler according to claim 12, wherein a cutting arrangement including opposed and relatively moveable first and second cutting edges positioned on opposite sides of the cap strip for cutting a connecting structure joining the leading cap to the succeeding cap when the leading staple is discharged and penetrates the leading cap.

15. A stapler according to claim 14, wherein one said cutting edge is fixed to said staple magazine and the other said cutting edge is carried on said guide structure.

16. A stapler according to claim 14, wherein one said cutting edge is fixedly secured to the staple magazine, and the other said cutting edge is movably mounted on said staple magazine.

17. A stapler according to claim 12, wherein the cap strip is spirally wound to define a roll which is rotatable in the cap magazine.

18. A stapler according to claim 17, wherein the connecting structure associated with the cap strip comprises a thin web which joins the serially adjacent caps.

19. A stapler according to claim 12, wherein the trigger member comprises a finger-engaging lever positioned to project outwardly away from a bottom surface of said housing and positioned adjacent an end of the grip structure which is closest to the forward end of said tool.

20. A stapler according to claim 12, wherein the grip structure is elongated lengthwise away from the cap magazine, said grip structure extending to a location disposed approximately midway between opposite ends of said elongated housing, said grip structure defining therein an interior guide passage extending from said cap magazine toward the forward end of said tool for feeding said cap strip therethrough.

21. A stapler according to claim 20, wherein said trigger member is positioned adjacent an end of said grip structure which is remote from said cap magazine and is disposed to permit continuous engagement with the user's finger.

22. A manually-swingable hammer-type stapler for discharging both a plastic cap and a staple which penetrates the cap upon discharge, comprising:

an elongate manually-swingable impact-actuated stapling tool including an elongate housing having an elongate staple magazine extending in a lengthwise direction thereof;

the elongate stapling tool adjacent one end of said housing having a staple driving blade for transversely discharging a leading staple from said staple magazine due to manual swinging of said entire tool so as to cause an impact area on said one end of said tool to be manually impacted against an external surface;

said tool adjacent the other end thereof defining an elongate handle part having a manually engagable grip structure for gripping engagement with a user's hand to permit manual swinging of the tool;

a cap magazine stationarily carried on said tool and supporting therein a plurality of plastic caps;

a guide structure carried on said housing and extending from said cap magazine to a position adjacent said one end of said tool and supporting thereon a row of caps serially positioned in adjacent edge-to-edge relationship so that a leading cap in said row is movable into a discharge position adjacent and generally transversely aligned with the leading staple; and a user-activated cap feeding mechanism which is wholly manually controlled for moving the cap row along the guide structure so that the leading cap is moved into the discharge position wholly independently of the staple discharge operation which is initiated by manually swingably impacting the impact area of the tool against the external surface;

said cap feeding mechanism including:

(a) a cap pusher movably supported on the tool for reciprocal back and forth movement between advanced and retracted positions which are spaced apart by a distance generally corresponding to the center-to-center spacing between adjacent caps in said row, said pusher moving the leading cap into the discharge position when the pusher moves into the advanced position, (b) a finger-activated trigger member movably supported on said housing and including a finger-engaging part which is externally accessible and engaged with and moved by the user's finger, (c) a link arrangement connected between the trigger member and the cap pusher to effect movement of the latter in response to finger-caused movement of the trigger member, and (d) a spring cooperating with the mechanism for urging the cap pusher toward a predefined one of said advanced and retracted positions; and said cap feeding mechanism being free of restraining or controlling connections to said driving blade so that the tool user can manually effect selective movement of the leading cap into the discharge position.

23. A stapler according to claim 22, wherein the trigger member is a finger-engagable lever which is pivotally supported on and protrudes outwardly from the housing in the vicinity of the handle part.

24. A stapler according to claim 22, wherein the plurality of caps is formed as a strip spirally wound as a coil with a free end portion of the strip being supplied from the coil and extending lengthwise along the tool for support by the guide structure to permit the leading cap to be disposed in said discharge position.

* * * * *